US009982968B2

(12) United States Patent
Thomas

(10) Patent No.: US 9,982,968 B2
(45) Date of Patent: May 29, 2018

(54) VIOLENT INTRUDER MITIGATION SHIELD

(71) Applicant: Nathan Daniel Thomas, Monroe, WA (US)

(72) Inventor: Nathan Daniel Thomas, Monroe, WA (US)

( * ) Notice: Subject to any disclaimer, the term of this patent is extended or adjusted under 35 U.S.C. 154(b) by 0 days. days.

(21) Appl. No.: 15/374,636

(22) Filed: Dec. 9, 2016

(65) Prior Publication Data

US 2017/0167829 A1 Jun. 15, 2017

Related U.S. Application Data

(60) Provisional application No. 62/266,546, filed on Dec. 11, 2015.

(51) Int. Cl.

| | |
|---|---|
| ***F41H 5/08*** | (2006.01) |
| ***B65D 25/04*** | (2006.01) |
| ***B65D 43/16*** | (2006.01) |
| ***B65D 43/20*** | (2006.01) |
| ***B65D 55/14*** | (2006.01) |
| ***B65D 25/28*** | (2006.01) |
| ***B65D 25/22*** | (2006.01) |
| ***F41C 33/06*** | (2006.01) |

(52) U.S. Cl.

CPC ..... *F41H 5/08* (2013.01); *B65D 25/04* (2013.01); *B65D 25/22* (2013.01); *B65D 25/28* (2013.01); *B65D 43/16* (2013.01); *B65D 43/20* (2013.01); *B65D 55/14* (2013.01); *F41C 33/06* (2013.01)

(58) Field of Classification Search

CPC . F41H 1/00; F41H 5/0407; F41H 5/06; F41H 5/08; F41H 5/12; F41H 5/26; F41C 33/06

USPC ..... 89/36.01, 36.06, 36.07, 921, 918, 926

See application file for complete search history.

(56) References Cited

U.S. PATENT DOCUMENTS

| | | | | | |
|---|---|---|---|---|---|
| 1,381,301 | A * | 6/1921 | Hargrave | A45C 13/18 | 109/36 |
| 1,561,564 | A * | 11/1925 | Nizamis | A45F 3/06 | 224/153 |
| 3,745,938 | A * | 7/1973 | Hathaway | F41H 5/08 | 109/49.5 |
| 3,762,345 | A * | 10/1973 | Sgariglia, Jr. | A45C 3/02 | 109/22 |
| 4,016,666 | A * | 4/1977 | Finn | F41A 17/56 | 42/1.01 |
| 4,153,927 | A * | 5/1979 | Owens | B43L 3/00 | 362/110 |
| 4,442,780 | A * | 4/1984 | Child | F41H 5/08 | 109/29 |
| 4,546,863 | A * | 10/1985 | Kaufman | A45C 3/02 | 109/49.5 |
| 4,678,702 | A * | 7/1987 | Lancaster | B32B 27/12 | 428/193 |
| 4,892,334 | A * | 1/1990 | Sinclair | B43L 3/001 | 108/42 |

(Continued)

*Primary Examiner* — Derrick R Morgan

(74) *Attorney, Agent, or Firm* — Seed IP Law Group LLP

(57) ABSTRACT

A violent intruder mitigation shield that provides a defender with ballistic protection along with options for communication, first aid, and counter-attack capability. The violent intruder mitigation shield may have a functional or decorative front layer that allows the shield to serve a secondary function in addition to functioning as a protective shield.

20 Claims, 6 Drawing Sheets

(56) References Cited

U.S. PATENT DOCUMENTS 4,919,037 A * 4/1990 Mitchell ..... B43L 3/005 109/49.5
5,048,682 A * 9/1991 Taylor ..... F41C 33/06 206/317
5,115,893 A * 5/1992 Terkildsen ..... A45C 3/02 190/102
5,392,686 A * 2/1995 Sankar ..... F41H 5/08 109/49.5
5,554,816 A * 9/1996 Skaggs ..... F41H 5/08 109/49.5
5,829,653 A * 11/1998 Kaiser ..... A45F 4/02 2/2.5
5,939,658 A * 8/1999 Muller ..... F41H 5/08 109/49.5
6,000,347 A * 12/1999 Madden, Jr. ..... A45C 9/00 109/22
6,009,790 A 1/2000 Tekorius
6,217,075 B1 * 4/2001 Tsai ..... B43L 3/005 248/452
6,389,949 B1 * 5/2002 Carreira ..... F41H 5/08 2/2.5
D495,746 S * 9/2004 Chen ..... D19/65
6,990,887 B1 * 1/2006 O'Donnell ..... F41H 5/08 89/36.02
7,124,675 B1 10/2006 Sand
7,146,899 B2 * 12/2006 Imblum ..... F41H 5/08 89/36.01
7,302,880 B1 * 12/2007 Elasic ..... F41H 5/08 89/36.01
7,716,748 B2 * 5/2010 Dovner ..... F41C 33/0209 2/2.5
7,736,012 B1 * 6/2010 Chu ..... B42F 9/002 362/98
8,418,595 B1 * 4/2013 Saucedo ..... F41H 5/08 89/36.01
9,027,810 B1 * 5/2015 Piersol ..... A45C 5/02 224/576
9,090,116 B2 * 7/2015 Tunis ..... B43L 1/00
9,168,779 B2 * 10/2015 Krapf ..... B43L 1/00
D753,764 S * 4/2016 Chuang ..... D19/88
9,310,170 B1 * 4/2016 Basewitz ..... F41H 5/14
9,500,441 B2 * 11/2016 Kirby, Jr. ..... F41C 33/06
9,501,101 B2 * 11/2016 Daley, III ..... G06F 1/163
9,752,856 B2 * 9/2017 Rashad ..... F41H 5/08
2004/0163913 A1 * 8/2004 Tschudy ..... A45C 5/06 190/111
2005/0053769 A1 * 3/2005 Imblum ..... F41H 5/08 428/170
2005/0116667 A1 * 6/2005 Mueller ..... E04F 13/08 315/312
2006/0003845 A1 * 1/2006 Hessie, Sr. ..... A63F 13/08 463/46
2008/0047860 A1 * 2/2008 Shane ..... F41A 17/02 206/317
2009/0294499 A1 * 12/2009 McKinney ..... A45C 13/08 224/576
2012/0247313 A1 * 10/2012 Peters ..... A47C 3/04 89/36.02
2014/0238225 A1 * 8/2014 Mickiewicz ..... F41H 5/08 89/36.07
2015/0083616 A1 * 3/2015 Kirby, Jr. ..... F41C 33/06 206/216
2016/0123702 A1 * 5/2016 Zeno ..... B42F 9/002 206/232
2017/0074307 A1 * 3/2017 Slagle ..... F16B 12/20
2017/0144423 A1 * 5/2017 Pilpel ..... B32B 37/12
2017/0167829 A1 * 6/2017 Thomas ..... F41H 5/08

* cited by examiner

VIOLENT INTRUDER MITIGATION SHIELD

CROSS REFERENCE TO RELATED APPLICATIONS

This application claims the benefit under 35 U.S.C. § 119(c) of U.S. Provisional Patent Application Ser. No. 62/266,546 filed on Dec. 11, 2015, the disclosure of which is incorporated in its entirety by reference herein.

BACKGROUND

The present invention relates to a shield that can be used to protect the occupants of a building from a violent intruder. The shield serves multiple functions, including providing a ballistic barrier and storage for equipment that might be needed in an emergency.

Many people feel insecure in their homes or workplaces because of the possibility of intrusion. Media reports of intruders armed with guns or other weapons attacking people in schools, offices, shops, and residences have become more common, and even a single armed intruder can inflict significant casualties. Often, the targets of such an intruder are unarmed and have few alternatives for self-defense.

In the event of an attack by one or more violent intruders, the defenders have a variety of immediate needs. These needs include protection from gunshots and other physical injuries, communication with emergency responders and other defenders, first aid for any injuries sustained, and weapons or devices for counter-attack, among others. Additional needs may be identified that are specific to the location and physical condition of the defenders or the type of attack.

Previous attempts to address the needs of defenders in a violent intruder scenario suffer from one or more disadvantages. Ballistic shields are known in the art, but have typically had no other functions. For example, U.S. Pat. No. 7,124,675 describes a portable ballistic shield for use by police and military personnel, and U.S. Pat. No. 6,009,790 describes a bullet-proof shield that can be hung on a wall to protect from accidental firearm discharge. Neither of these shields incorporate any features that would address the needs of defenders other than protection from gunshots.

There has also been some attempt to create bulletproof shields from other objects that would normally be present. For example, U.S. Pat. No. 9,090,116 describes a whiteboard or smartboard, such as might be found in a classroom or office environment, modified to include layers of bulletproof material. U.S. Pat. No. 7,146,899 describes a clipboard, serving tray, or other hand-held object that has been modified to include layers of bulletproof material. Neither of these devices addresses all the needs of a defender in a violent intruder situation.

There remains a need for an all-in-one device that provides ballistic protection along with options for communication, first aid, and counter-attack capability in a customizable manner for defenders in a violent intruder scenario.

SUMMARY

The following embodiments and aspects thereof are described and illustrated in conjunction with systems, tools and methods which are meant to be exemplary and illustrative, not limiting in scope.

In one embodiment, the present invention may take the form of a violent intruder mitigation shield. The shield contains a bullet-resistant layer for protection from gunshots and includes a cavity that may be used for storage of items that might be required in an emergency.

In another embodiment, the cavity may be accessed by a door. The door may be a hinged or a sliding door, and may be secured by a lock. The lock may be any kind of lock known in the art, including mechanical, electronic, biometric, or magnetic locks.

In another embodiment, the cavity may be divided into two or more compartments. The compartments may include recesses shaped to hold items that might be required in an emergency. These items may include a gun, an electroshock weapon, a communication device, a first aid kit, a pepper spray, and a flashlight. Additional or different items could be stored in the compartments as appropriate for the location of the shield, identity of the defenders, or type of anticipated attack.

In another embodiment, the present invention may further include one or more handles on the back of the violent intruder mitigation shield that allow the defender to support the shield in a protective position with one hand. The handles may include straps that fit around the defender's forearm as well as a handle or strap for the defender's hand. One or more of the straps may be removable from the shield and may be used as a tourniquet in the event of an injury.

In another embodiment, the present invention may further include one or more mirrored surfaces on the back of the violent intruder mitigation shield that allow the defender to see behind himself or herself without turning around.

In another embodiment, the present invention may further include a means for removably hanging the violent intruder mitigation shield on a vertical surface, such as a wall. The hanging means may comprise a French cleat or hook. In an alternative embodiment, the present invention may further include a hinge or swiveling arm that connects the violent intruder mitigation shield to a vertical surface, such as a wall. The hinge or swiveling arm allows the shield to be pushed back against the wall for storage and to swing out at an angle to the wall when needed. For example, the defender could swing the shield out at 90° to the wall and stand behind the shield, or the defender could swing the shield 180° to cover an adjacent window or doorway and protect the entire room.

In another embodiment, the present invention may further include a decorative or functional surface that allows the violent intruder mitigation shield to either serve a secondary purpose or to be unobtrusive in its desired location. For example, a functional surface such as a whiteboard, smartboard, chalkboard, projection screen, clipboard, or pocket chart would allow the shield to function as any of these items under normal circumstances and be conveniently available for use as a shield in the event of a violent intrusion. A decorative surface such as a picture, sign, abstract design, or mirror would allow the violent intruder mitigation shield to fit into the interior design scheme of the room in which it is placed and would serve to disguise the shield, while also allowing the shield to be conveniently available for use as a shield in the event of a violent intrusion.

In one embodiment, the present invention may take the form of a violent intruder mitigation shield sized to protect the head and torso of the defender. In an alternative embodiment, the present invention may take the form of a violent intruder mitigation shield sized to protect substantially the entire body of the defender.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION

Figure 1A:
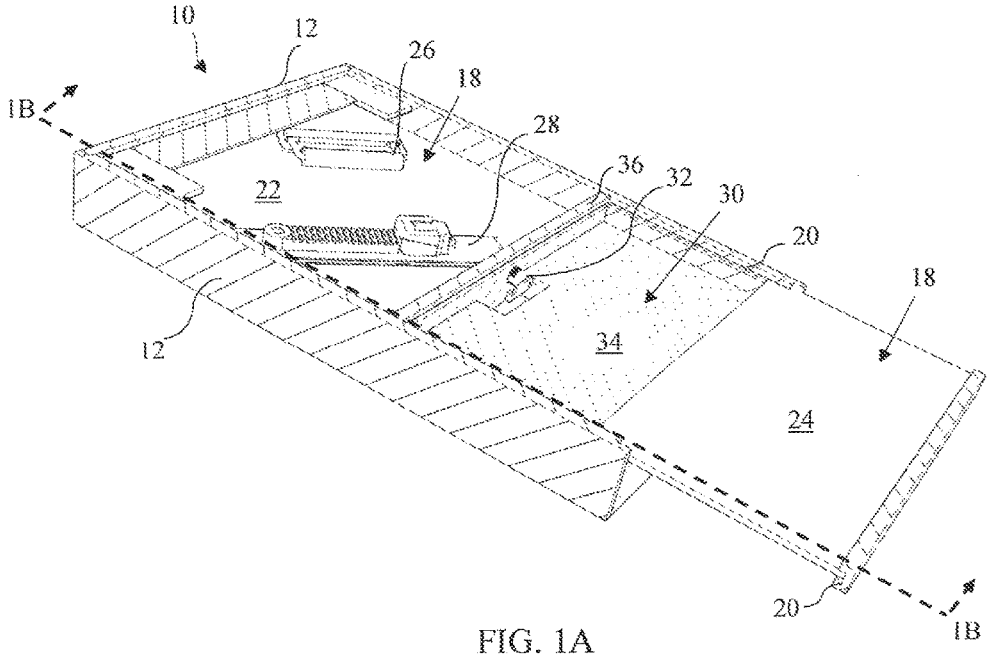
FIG. 1A is a rear perspective view of a violent intruder mitigation shield with the door open, according to one embodiment of the present invention.
Figure 1B:
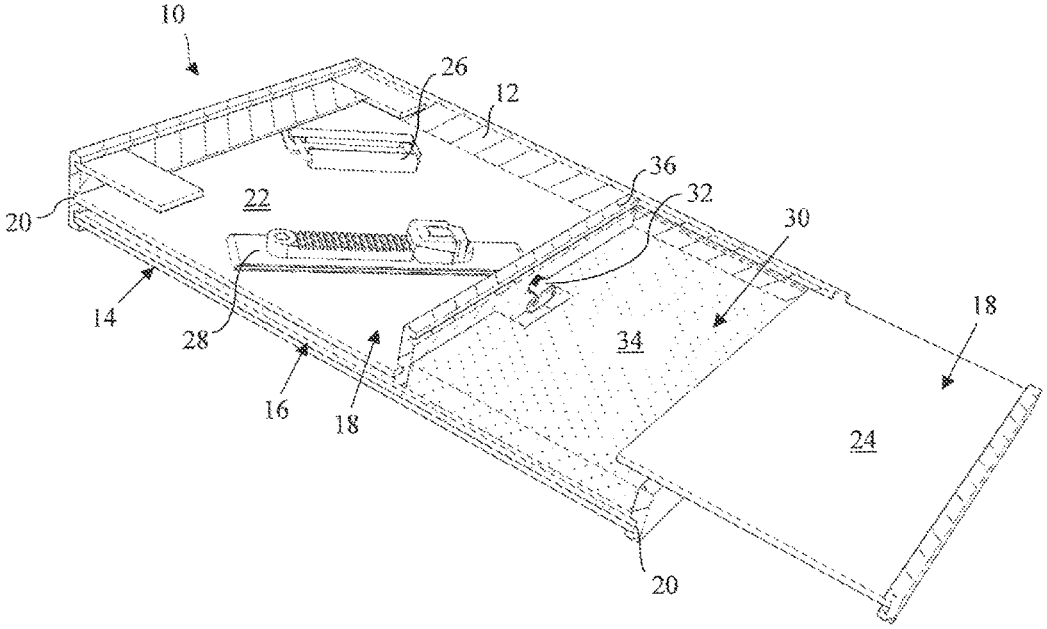
FIG. 1B is a cross-section view of a violent intruder mitigation shield with the door open, according to one embodiment of the present invention.

Referring to FIGS. 1A and 1B, in one embodiment, the invention may take the form of a violent intruder mitigation shield 10. FIG. 1B is a cross-sectional view of the shield 10 taken through the dotted lined indicated in FIG. 1A, which better illustrates the relationships of the various components in one embodiment of the invention. The shield 10 has a frame 12. The frame 12 encloses a front layer 14, a bullet-resistant layer 16, and a back layer 18. The frame 12 can be made of any appropriate material, including wood, plastic, fiberglass, ceramic, carbon fiber, metal, and composites such as flax linen fabric with bio-epoxy. Combinations of materials can also be used. In one embodiment, the frame is made of wood. In an alternative embodiment, the frame is made of a composite such as flax linen fabric and bio-epoxy, for example Ekoa,® available from Lingrove, LLC. In one embodiment, the frame may be formed by a molding process such as compression molding, resin transfer molding (RTM) vacuum assisted resin transfer molding (VARTM), light resin transfer molding (LRTM), wet layup, injection molding, or any other molding process appropriate to the material used. The frame can be any substantially planar shape, including a rectangle or other polygonal shape or a curvilinear shape. The frame can be a regular curvilinear shape, such as a circle or oval, or an irregular curvilinear shape. In one embodiment, the shield 10 is sized to protect the head and torso of a defender. In an alternative embodiment, the shield is sized to protect substantially the whole body of one or more defenders. In one embodiment, the front layer 14, bullet-resistant layer 16, and back layer 18 are secured to the frame 12 by any means appropriate to the materials used, including the use of fasteners and adhesives. In a preferred embodiment, the front layer, bullet-resistant layer, and back layer are secured to the frame by means of dados 20 in the frame 12 sized to accept the edges of the front layer, bullet-resistant layer, and back layer.

The bullet-resistant layer 16 can be made of any bullet-resistant material known in the art that can be formed into a substantially planar layer. The bullet-resistant layer 16 can be a single layer of bullet-resistant material or it can be made up of multiple layers of bullet-resistant material. The different layers may be made of the same or different materials. Bullet-resistant materials that can be used include metal, metal alloy, ceramic, glass, fiberglass, polymer, polycarbonate, polyester, aramid, polyolefin, carbon fiber, UHMWPE (ultra high molecular weight polyethylene), resin, and composite materials such as fiber-reinforced resin. Combinations of materials can also be used. In a preferred embodiment, the bullet-resistant layer 16 is made of Kevlar®, KevlarXP®, polycarbonate, Dyneema®SB2, Dyneema®SB50, Dyneema®SB26, or fiberglass. The bullet-resistant material used and the thickness of the bullet-resistant layer can be selected and configured to protect against the anticipated threat in the environment in which the shield 10 may be placed. For example, the bullet-resistant layer can be designed to protect against an intruder armed with a hand gun, a shot gun, or a rifle.

The back layer 18 can be made of any material appropriate for forming the back surface of the shield 10, including wood, plastic, fiberglass, ceramic, carbon fiber and metal. In one embodiment, the back layer comprises two or more sections. In a preferred embodiment, the back layer 18 comprises an upper section 22 and a lower section 24. In one embodiment, a handle 26 is attached to the upper section 22. The handle can be any appropriate shape and material that can be gripped by the defender. The handle can be integral to the upper section 22, or can be attached to the upper section by any appropriate means, including fasteners and adhesives. In one embodiment, the handle folds flat against the upper section when not in use. In a preferred embodiment, a second handle 28 is also attached to the upper section 22. The second handle can take the form of one or more straps that fit around the defender's forearm. In one embodiment, the second handle is made of one or more fabric straps that are adjustable in length, allowing the defender to adjust the length of the straps to fit snugly and comfortably around the defender's forearm. The second handle can be any appropriate shape and material that will fit around the defender's forearm, including synthetic materials such as nylon fabric and natural materials such as cotton fabric and leather. The second handle can be attached to the upper section by any appropriate means, including fasteners and adhesives. In a preferred embodiment, the second handle 28 is detachable from the upper section 22 and can be used as a tourniquet.

In one embodiment, the shield 10 includes a cavity 30 located between the bullet-resistant layer 16 and the back layer 18, and surrounded by the frame 12. In one embodiment, the back layer 18 is divided into an upper section 22 and a lower section 24, which are separated by a divider 36. In a preferred embodiment, the lower section is a sliding door that can be opened to access the cavity 30. The two or more different sections of the back layer, for example, the upper section 22 and the lower section 24, can be attached to the frame 12 at different distances away from the bullet-resistant layer 16, creating areas in which the depth of the cavity 30 is different. In one embodiment, the distance between the bullet-proof layer and the lower section is greater than the distance between the bullet-proof layer and the upper section. This difference allows the handles 26 and 28 to be inset relative to the lower section 24, which provides greater stability when the shield is held by a defender using the handles. The difference in distances also allows the cavity 30 to have greater volume accessible through the lower section, permitting the storage of larger or bulkier items within the cavity.

In one embodiment, one or more of the different sections of the back layer 18 is a door that can be opened to access the cavity 30. In a preferred embodiment, lower section 24 is a door. The door can be any type of door that can open and close, for example a hinged door or a sliding door. In a preferred embodiment, the lower section is a sliding door. The door may open in any direction around the perimeter of the shield. For example, the door may open such that it extends toward the ground or to either side when the shield is being held by a defender using the handles attached to the back layer. In a preferred embodiment, the door is secured by a lock 32. The lock can be any kind of lock known in the art, including a mechanical lock, an electronic lock, a biometric lock, and a magnetic lock. In one embodiment, the lock requires a matching key to lock and unlock. The key can be a mechanical key or it can be a non-mechanical key. Examples of non-mechanical keys include magnetic and electronic keys, such as cards or other objects with a magnetic strip, radio frequency identification device (RFID), or embedded integrated circuit chip. In one embodiment, the lock can be opened without a key, for example by entering a code on a keypad or placing a finger on a fingerprint reader. In an alternative embodiment, the door is secured by simple mechanical or magnetic latch.

In one embodiment, the cavity 30 contains padding 34 that conforms to items placed in the cavity 30. The padding 34 can be foam, fabric, or any other appropriate material that will fit snugly around items placed in the cavity. In one embodiment, the padding contains voids or recesses of the size and shape of the items to be placed in the cavity. In an alternative embodiment, the padding deforms to snugly hold items placed in the cavity. In one embodiment, the cavity is divided into two or more compartments. The compartments can contain padding as described above, or the compartments can be shaped to hold items securely without padding.

In one embodiment, the cavity 30 contains items that might be useful in a violent intruder scenario. The specific items contained in the cavity can be selected to be appropriate for the environment in which the shield is to be placed, the identity and condition of the defenders, and the type of anticipated attack. For example, the cavity can contain one or more of a gun, an electroshock weapon, a communication device, a first aid kit, a pepper spray, and a flashlight. The communication device can be a telephone, a two-way radio, or any other portable communication device known in the art. Additional or different items can be contained in the cavity as appropriate for the circumstances. The items contained in the cavity can be changed if the environment, defenders, or type of anticipated attack changes.

Figure 2A:
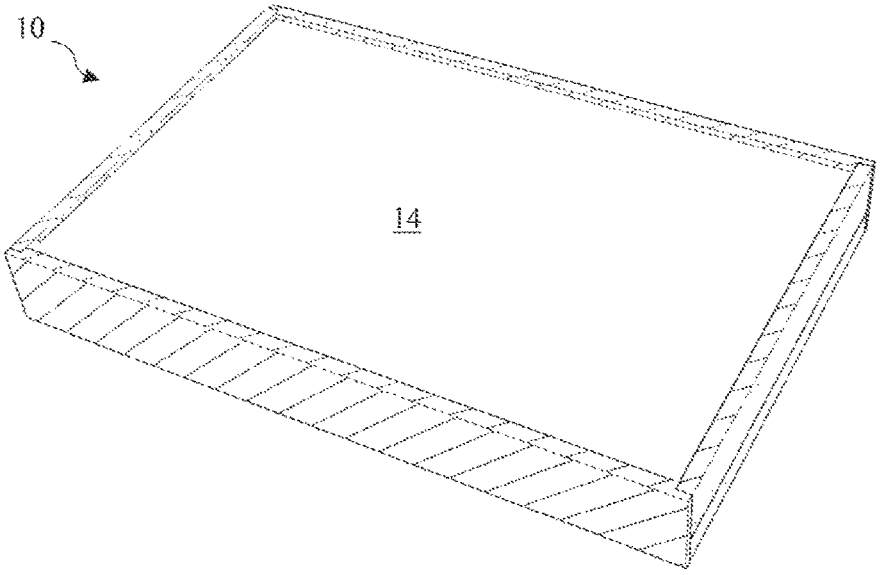
FIG. 2A is a front perspective view of a violent intruder mitigation shield with the door closed, according to one embodiment of the present invention.

Referring now to FIG. 2A, in one embodiment, the front layer 14 can be made of any material appropriate for forming the front surface of the shield 10. In one embodiment, the front layer is made of a functional material that allows the shield to serve a secondary purpose appropriate to the environment in which the shield is placed, and may also disguise the shield. In a preferred embodiment, the front layer 14 is a whiteboard, smartboard, chalkboard, projection screen, clipboard, corkboard, or pocket chart. These materials are particularly appropriate for use in an office or classroom setting. Other functional materials can be used that are appropriate to other environments in which the shield may be placed.

In an alternative embodiment, the front layer 14 is made of a decorative material that allows the shield 10 to fit into the interior design scheme of the room in which it is placed and may also disguise the shield. In a preferred embodiment, the front layer is a picture, a sign, an abstract design, or a mirror. These materials are particularly appropriate for use in an office, shop, or residential setting. Other decorative materials can be used that are appropriate to other environments in which the shield may be placed.

Figure 2B:
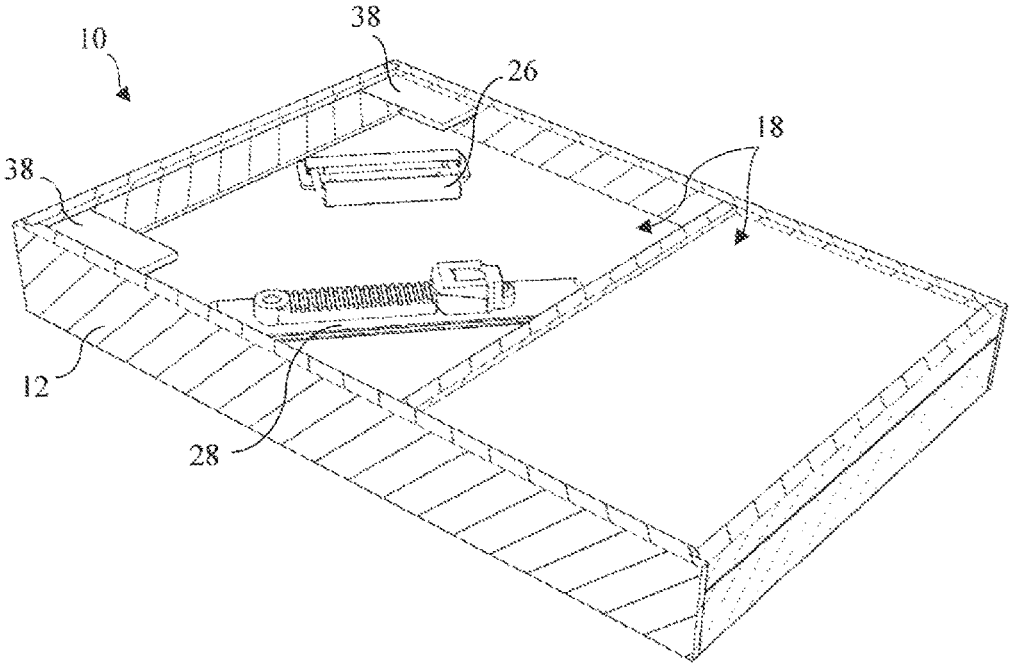
FIG. 2B is a rear perspective view of a violent intruder mitigation shield with the door closed, according to one embodiment of the present invention.

Referring now to FIG. 2B, in one embodiment, the shield 10 further comprises one or more mirrors 38 that allow the defender to see behind himself or herself without turning around. The mirrors 38 are placed on the shield so that the mirrored surface of each mirror faces toward a defender using one or more of the handles, for example handle 26 and second handle 28, to hold the shield 10. One or more mirrors can be placed at any location or locations on the frame 12 or the back layer 18 that allow a defender holding the shield by the handles to see behind himself or herself using the mirrors. The mirrors can be attached to the frame or the back layer by any appropriate means, including fasteners and adhesives.

Figure 3:
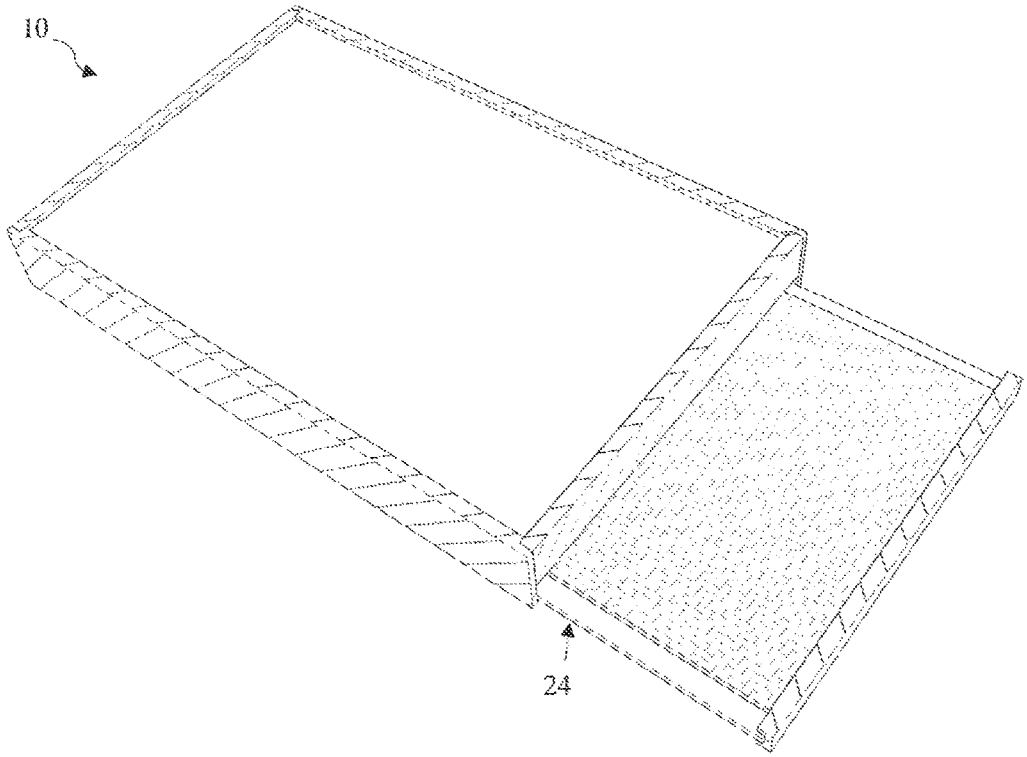
FIG. 3 is a front perspective view of a violent intruder mitigation shield with the door open, according to one embodiment of the present invention.

Referring now to FIG. 3, in one embodiment, the back layer of the shield 10 is divided into one or more sections, for example, an upper section and lower section, one or more of which is a door, as described above. In one embodiment, the lower section 24 is a door. In a preferred embodiment, the door comprises a bullet-resistant material. The bullet-resistant material can be an internal layer of the door, or the bullet-resistant material can be on the surface of the door that faces away from a defender when the door is open and the defender is holding the shield by the handle or handles on the back layer. The bullet-resistant material can be a single layer of bullet-resistant material or it can be made up of multiple layers of bullet-resistant material. The different layers may be made of the same or different materials. The bullet-resistant material can be any bullet-resistant material known in the art, including metal, metal alloy, ceramic, glass, fiberglass, polymer, polycarbonate, polyester, aramid, carbon fiber, UHMWPE, polyolefin, resin, and composite materials such as fiber-reinforced resin. Combinations of materials can also be used. In a preferred embodiment, the bullet-resistant material used on the door is Kevlar®, KevlarXP®, polycarbonate, Dyneema®SB2, Dyneema®SB50. Dyneema®SB26, or fiberglass. The bullet-resistant material used on the door can be the same or different from the bullet-resistant material used in the bullet-resistant layer.

Figure 4A:
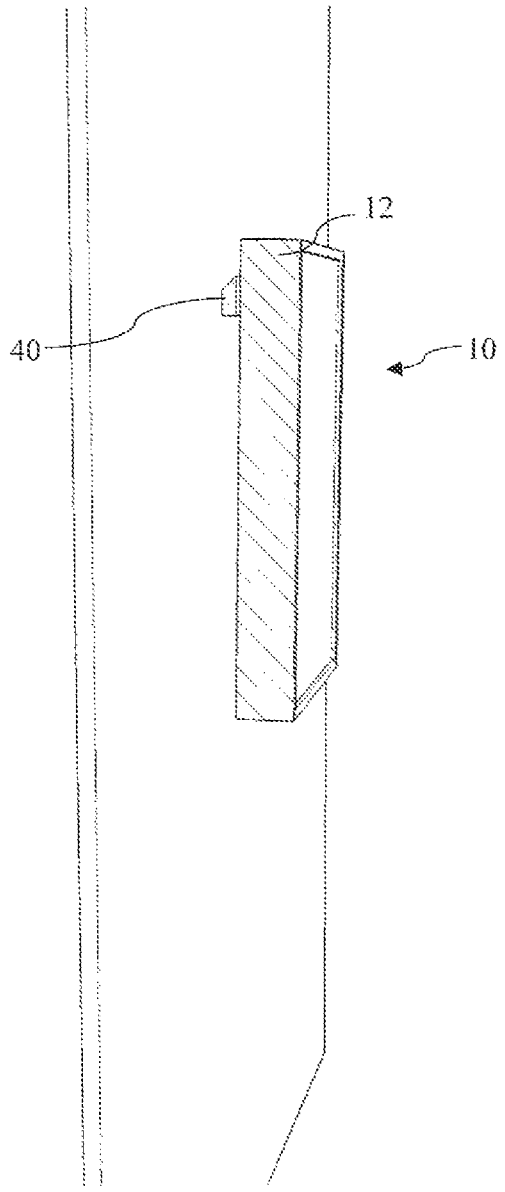
FIG. 4A is a perspective view of a violent intruder mitigation shield removably mounted to a vertical surface with a French cleat.

Referring now to FIG. 4A, in one embodiment, the shield 10 includes a means for hanging the shield on a vertical surface, such as a wall, that allows a defender to quickly and easily remove the shield for use. The means for hanging the shield can be any means known in the art, including a book, bracket, or other fastener. In a preferred embodiment, the means for hanging the shield 10 is a French cleat 40. French cleats are well known in the art, and consist of an upper half and a lower half that fit together at an angle. The upper half of the French cleat can be attached to any appropriate part of the shield 10, including the frame 12. The lower half of the French cleat can be attached to the vertical surface. When the upper half of the French cleat is placed on the lower half of the French cleat, the shield is held against the vertical surface. The shield can be removed from the vertical surface simply by lifting the shield high enough to allow the upper half of the French cleat to clear the lower half of the French cleat. The French cleat can be made of any appropriate material, including wood, plastic, fiberglass, ceramic, carbon fiber, and metal.

Figure 4B:
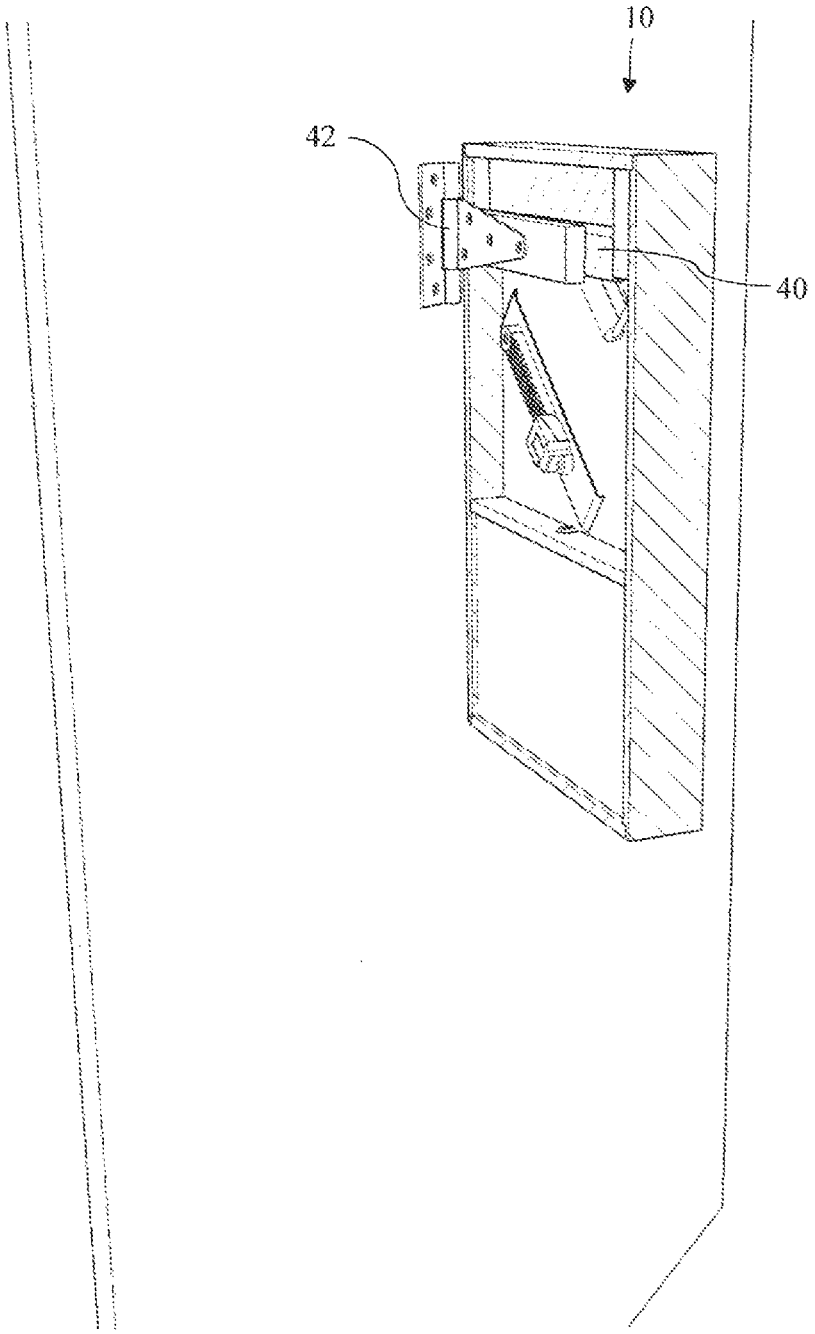
FIG. 4B is a perspective view of a violent intruder mitigation shield mounted to a vertical surface with a hinge.

Referring now to FIG. 4B, in one embodiment, the shield 10 includes a means for hanging the shield on a vertical surface, such as a wall, that allows a defender to swing the shield out from the wall. In a preferred embodiment, the means for hanging the shield 10 is a hinge 42. The hinge can be made of any appropriate material, including plastic and metal. In one embodiment, one side of the hinge can be attached to the shield and the other side of the hinge can be attached to the vertical surface. The hinge can be attached to the shield and the vertical surface by any appropriate means, including fasteners and adhesives. In an alternative embodiment, one side of the hinge 42 can be attached to the lower half of a French cleat 40, the upper half of the French cleat being attached to the shield 10, or other hanging means that allow the shield to be removably attached to the vertical surface. In a preferred embodiment, the hinge allows the shield to rest against the wall when not in use and to swing out at an angle to the wall when required. In one embodiment, the angle between the shield and the vertical surface can be varied between about 0® and about 30°, 40°, 50°, 60°, 70°, 80°, or 90°. In another embodiment, the angle between the shield 10 and the vertical surface can be varied between about 0° and about 30°, 40°, 50°, 60°, 70°, 80°, 90°, 100°, 110°, 120°, 130°, 140°, 150°, 160°, 170°, or 180°. In one embodiment, the shield can swing out from a vertical surface, such as a wall, to cover an adjacent opening, such as a door or window.

Figure 4C:
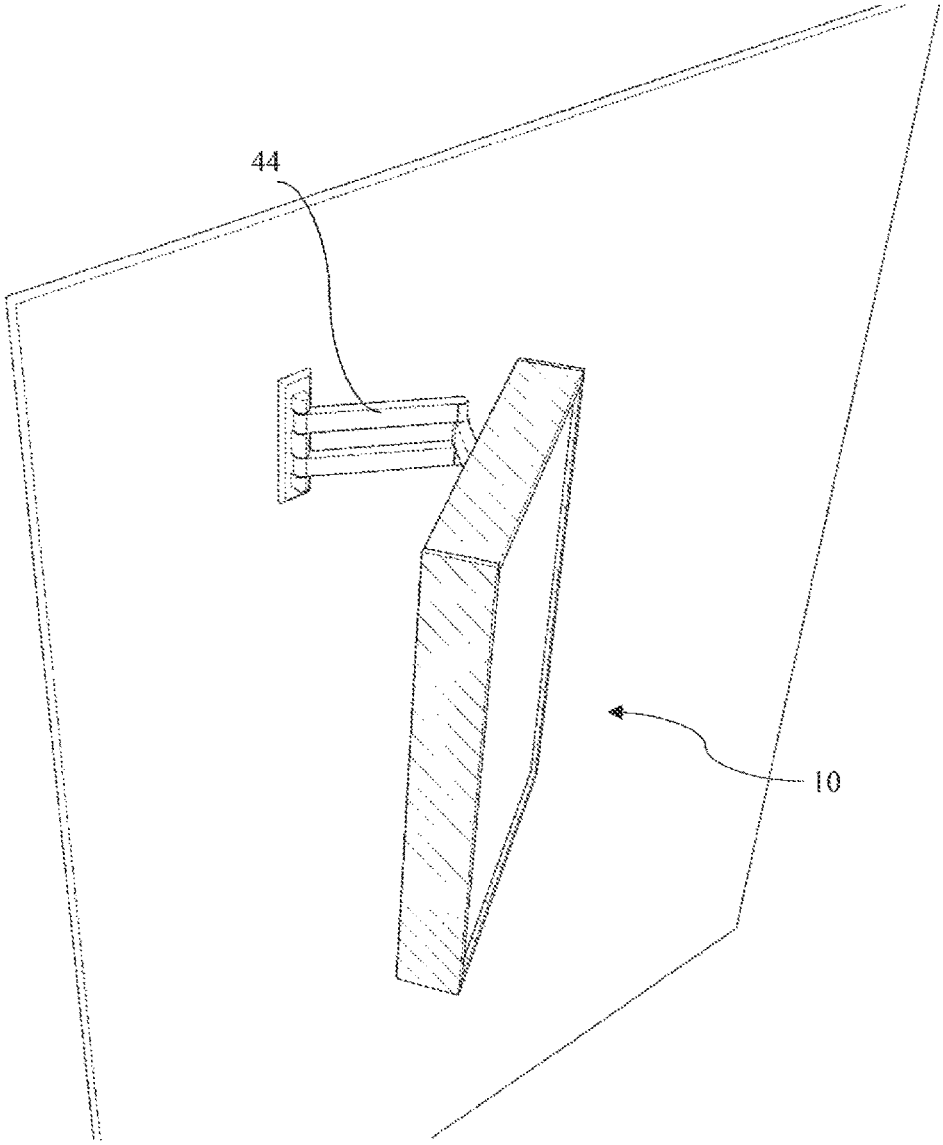
FIG. 4C is a perspective view of a violent intruder mitigation shield mounted to a vertical surface with a swiveling arm.

Referring now to FIG. 4C, in one embodiment, the shield 10 includes a means for hanging the shield on a vertical surface, such as a wall, that allows a defender to swing the shield out from the wall. In a preferred embodiment, the means for hanging the shield 10 is a swiveling arm 44. The swiveling arm may be similar to a swiveling television mount. The swiveling arm can be made of any appropriate material, including plastic and metal. One end of the swiveling arm 44 can be attached to the shield 10 and the other end of the swiveling arm can be attached to the vertical surface. The swiveling arm can be attached to the shield and the vertical surface by any appropriate means, including hooks, fasteners, and adhesives, and may be either permanently attached or removably attached. In one embodiment, one end of the swiveling arm is attached to the vertical surface in a permanent or semi-permanent manner, for example by use of screws or adhesives, while the other end of the swiveling arm is removably attached to the shield, for example by use of hooks or brackets. In a preferred embodiment, the swiveling arm allows the shield to rest close to the wall, and substantially parallel to the wall, when not in use and to swing out at an angle to the wall when required. In one embodiment, the angle between the shield and the vertical surface can be varied between about 0° and about 30°, 40°, 50°, 60°, 70°, 80°, or 90°. In another embodiment, the angle between the shield and the vertical surface can be varied between about 0° and about 30°, 40°, 50°, 60°, 70°, 80°, 90°, 100°, 110°, 120°, 130°, 140°, 150°, 160°, 170°, or 180°. In one embodiment, the shield can swing out from a vertical surface, such as a wall, to cover an adjacent opening, such as a door or window.

From the foregoing, it will be appreciated that, although specific embodiments of the invention have been described herein for purposes of illustration, those possessed of skill in the art will recognize certain modifications, permutations, additions and sub-combinations thereof may be made without deviating from the spirit and scope of the invention. Accordingly, the invention is not limited except as by the appended claims.

The invention claimed is:

1. A violent intruder mitigation shield, comprising:

(a) a frame defining a substantially planar interior space;

(b) a front layer having a forward face and a rear face, the front layer being disposed within the substantially planar interior space defined by the frame;

(c) a bullet-resistant layer having a forward face and a rear face, the bullet-resistant layer being disposed within the substantially planar interior space defined by the frame such that the forward face of the bullet-resistant layer faces the rear face of the front layer;

(d) a back layer having a forward face and a rear face, the back layer being disposed within the substantially planar interior space defined by the frame such that the forward face of the back layer faces the rear face of the bullet-resistant layer; wherein the bullet-resistant layer, the back layer, and the frame define a cavity, and wherein the hack layer comprises two or more sections, wherein at least one back layer section is a door positionable in an open position or a closed position such that when the door is in the open position the cavity is accessible and when the door is in the closed position the cavity is inaccessible, and wherein the door is bullet resistant; and wherein the door is a sliding door.

2. The violent intruder mitigation shield of claim 1, wherein the door further comprises a lock that secures the door in the closed position when locked and allows the door to be moved to the open position when unlocked.

3. The violent intruder mitigation shield of claim 2, wherein the lock is a mechanical lock, an electronic lock, a biometric lock, or a magnetic lock.

4. The violent intruder mitigation shield of claim 1, wherein the cavity is divided into two or more compartments.

5. The violent intruder mitigation shield of claim 1, wherein the cavity further comprises one or more recesses shaped to hold an accessory item.

6. The violent intruder mitigation shield of claim 5, wherein the one or more recesses are shaped to hold one or more of a gun, an electroshock weapon, a communication device, a first aid kit, a pepper spray, and a flashlight.

7. The violent intruder mitigation shield of claim 1, further comprising one or more handles attached to the rear face of the back layer.

8. The violent intruder mitigation shield of claim 1, further comprising one or more mirrors having a mirrored surface and an opposed unmirrored surface, wherein the unmirrored surface of the mirrors faces the rear surface of the back layer.

9. The violent intruder mitigation shield of claim 1, further comprising a hanging assembly for removably hanging the violent intruder mitigation shield on a vertical surface.

10. The violent intruder mitigation shield of claim 9, wherein the hanging assembly comprises a French cleat having an upper half and a lower half, wherein the upper half is attached to the violent intruder mitigation shield and the lower half is attached to the vertical surface.

11. The violent intruder mitigation shield of claim 1, further comprising a hanging assembly for mounting the violent intruder mitigation shield on a vertical surface such that the horizontal angle between the violent intruder mitigation shield and the vertical surface can be varied.

12. The violent intruder mitigation shield of claim 11, wherein the hanging assembly is a hinge.

13. The violent intruder mitigation shield of claim 11, wherein the hanging assembly is a swiveling arm.

14. The violent intruder mitigation shield of claim 1, wherein the forward face of the front layer comprises a decorative finish.

15. The violent intruder mitigation shield of claim 14, wherein the decorative finish comprises a picture, a sign, an abstract design, or a mirror.

16. The violent intruder mitigation shield of claim 1, wherein the forward face of the front layer comprises a functional finish.

17. The violent intruder mitigation shield of claim 16, wherein the functional finish comprises a whiteboard, smartboard, chalkboard, corkboard, projection screen, clipboard, or pocket chart.

18. The violent intruder mitigation shield of claim 1, wherein the violent intruder mitigation shield is sized to protect substantially the entire head and torso region of a person.

19. The violent intruder mitigation shield of claim 1, wherein the violent intruder mitigation shield is sized to protect substantially the whole body of a person.

20. The violent intruder mitigation shield of claim 1, wherein the bullet-resistant surface area of the shield is greater when the door is open than when the door is closed.

* * * * *